US005582519A

United States Patent [19]

Buchter

[11] Patent Number: 5,582,519

[45] Date of Patent: Dec. 10, 1996

[54] MAKE-FIRST-BREAK-LAST GROUND CONNECTIONS

[75] Inventor: Randolph L. Buchter, Harrisburg, Pa.

[73] Assignee: The Whitaker Corporation, Wilmington, Del.

[21] Appl. No.: 356,620

[22] Filed: Dec. 15, 1994

[51] Int. Cl.[6] ..... H01R 4/66

[52] U.S. Cl. ..... 439/101; 439/608

[58] Field of Search ..... 439/92, 101, 108, 439/607, 608, 850, 849, 856, 884

[56] References Cited

U.S. PATENT DOCUMENTS

| | | | |
|---|---|---|---|
| 2,816,275 | 12/1957 | Hammell | 439/850 |
| 3,697,926 | 10/1972 | Krafthefer | 339/17 L |
| 3,818,423 | 6/1974 | McDonough | 339/258 P |
| 3,832,770 | 9/1974 | Gluntz | 29/630 D |
| 4,140,361 | 2/1979 | Sochor | 339/258 P |
| 4,175,821 | 11/1979 | Hunter | 339/258 R |
| 4,720,276 | 1/1988 | Takahashi | 439/861 |
| 5,104,329 | 4/1992 | Brown et al. | 439/108 |
| 5,116,230 | 5/1992 | Dechelette et al. | 439/101 |
| 5,135,414 | 8/1992 | Van Dijk | 439/692 |
| 5,162,001 | 11/1992 | Harwath et al. | 439/608 |
| 5,169,324 | 12/1992 | Lemke et al. | 439/101 |
| 5,207,603 | 5/1993 | Peloza | 439/884 |
| 5,299,950 | 4/1994 | Kaneko | 439/342 |
| 5,334,053 | 8/1994 | Noschese | 439/682 |
| 5,360,349 | 11/1994 | Provencher et al. | 439/108 |
| 5,399,098 | 3/1995 | Marshall et al. | 439/849 X |

FOREIGN PATENT DOCUMENTS 1374648 1/1965 France .

*Primary Examiner*—Khiem Nguyen

[57] ABSTRACT

An electrical connector assembly (2) comprises blade connector (4) and a receptacle connector (6) mating with the blade connector. The blade connector (4) comprises an insulating housing (8) containing power or signal blade contacts having contact blades (70) and a ground blade contact having a contact blade (42). A tab (64) projects in the mating direction from the forward edge (66) of the ground contact blade (42). The receptacle connector (6) has an insulating housing (72) with receptacle contacts (96) disposed in respective cavities (82, 84) in the housing (72). Each receptacle contact (96) has contact springs (108, 114) having contact surfaces (110, 120). The receptacle contact (96) in the center cavity (82) is a ground receptacle contact, whilst the receptacle contacts (96) in the remaining cavities are power or signal contacts. When the connectors (4, 6) are mated, the tab (64) first engages the ground receptacle contact (96) in the center cavity (82) and thus makes the ground circuit of the connector assembly (2). The forward edges (66, 71) of the contact blades (42, 70) then pass substantially simultaneously between the contact surfaces (110, 120) of the respective receptacle contacts (96) and the tab (64) is received in an opening (124) defined between the contact springs (108, 114) of the ground receptacle contact (96). Upon unmating of the connectors (4, 6) the tab (64) is withdrawn from the contact surfaces (110, 120) of the ground receptacle contact (96) after the contact blades (42, 70) have been withdrawn from the receptacle contact (96).

19 Claims, 12 Drawing Sheets

MAKE-FIRST-BREAK-LAST GROUND CONNECTIONS

FIELD OF THE INVENTION

This invention relates generally to make-first-break-last ground connections and relates in particular to a pair of mating ground contacts for this purpose, an electrical connector assembly and an electrical blade contact.

BACKGROUND OF THE INVENTION

In an electrical connector assembly comprising mating electrical connectors and having a power or signal circuit and a ground circuit, it is desirable that the ground circuit should be made before the power or signal circuit when the connectors are mated and that when the connectors are unmated the power or signal circuit should be broken before the ground circuit.

U.S. Pat. No. 5,116,230 teaches that a make-first-break-last facility may be provided by making ground pins of a pin header longer than signal pins of the header so that the ground pins engage ground contacts of a mating connector, before the signal pins engage signal contacts thereof. A similar connector assembly is disclosed in U.S. Pat. No. 5,104,329 but in which, ground plates instead of ground pins are provided, these ground plates having outwardly bowed contact surfaces at their mating ends. U.S. Pat. No. 5,169,324 discloses an electrical connector assembly in which a connector mounted on a circuit board has signal contact springs for mating with complementary contact elements of a mating connector, similarly mounted on a circuit board. A planar grounding blade projects beyond the signal contact springs for mating with a grounding contact of the mating connector. The grounding contact consists of a contact spring having a bowed contact surface engaging a flat plate, the grounding blade being insertable between the bowed contact surface and the plate. U.S. Pat. No. 3,697,926 discloses an electrical terminal comprising a flat plate and a contact spring extending from a forward edge of the plate and being bent back rearwardly to form a loop. A tongue projects from the forward edge of the flat plate through a slot in the contact spring and is soldered to a printed circuit board. French Patent No. 1,374,648 discloses a receptacle contact for receiving a contact blade. The receptacle contact comprises a rearward base from which extend forwardly, first and second contact springs having bowed the contact surfaces for engaging opposite faces of the blade. The first contact spring is in the form of a cantilever arm, the second contact spring comprising a pair of spring arms extending from the base, one on either side of the first contact spring. The spring arms of the second contact spring are connected at their ends by a strap. The contact surfaces of the second contact spring are formed on the spring arms thereof and so are divided by a slot defined by the spring arms of the second contact spring. The slot is substantially narrower than the contact blade throughout its length.

SUMMARY OF THE INVENTION

An object of the invention is to provide improved economy in the manufacture of electrical ground contacts for a make-first-break-last grounding connection in the electrical connector assembly having ground and power or signal contacts. To this end, a pair of mating electrical ground contacts comprises a blade contact having a rearward blade support for retention in a first insulating housing, a contact blade projecting forwardly from the blade support and a tab which is substantially narrower than the contact blade projecting forwardly from a forward edge of the contact blade. The pair of ground contacts further comprises a receptacle contact having a rearward base for retention in a second insulating housing, and first and second contact springs projecting forwardly from the base. The first contact spring has a first transverse contact surface, the second contact spring having a transverse contact surface which is substantially wider than the tab. The contact surfaces of the contact springs cooperate to apply contact forces initially to the tab and then to the contact blade as the ground contacts are being mated. In order to allow full mating of the contact blade with the receptacle contact, the second contact spring defines a rearward opening for receiving the tab.

By virtue of this structure, the contact blade of the blade contact, need not, where the ground contacts are used in a make-first-break-last connector assembly, be any longer than, and is preferably of the same length as, power or signal contact blades of the assembly. Since the tab is substantially narrower than the contact blade of the ground blade contact, there is afforded economy of metal in the manufacture of the ground blade contact. At the same time, where the contact blades of the power or signal blade contacts, are of the same effective length as the ground contact blade of the ground blade contact, all of the contact blades can engage their receptacles substantially simultaneously in order to handle the full current load.

Where the contact surface of the first contact spring of the receptacle contact is substantially narrower than the contact surface of the second contact spring, the first contact spring can, in manufacture, be economically struck out from the stock which is used to form the second contact spring, at the same time leaving the second contact spring with a wide and continuous contact surface supported from the base of the receptacle contact by a pair of spring arms one on each side of the first contact spring and providing said rearward opening for receiving the tab. In the interest of manufacturing, and inventory keeping convenience, all the contacts of the connector assembly can conveniently be identical excepting that the contact blade of the ground blade contact is provided with the tab, whereas the remaining contact blades are not. Alternatively, one of the other contact blades also may be provided with a tab that is shorter in length than the tab on the ground blade contact, thereby establishing a make-first, make-second, and a make-last arrangement.

According to an aspect of the invention, an electrical connector assembly comprises mating electrical connectors having a ground blade contact for mating with a ground receptacle contact and current transmitting blade contacts, that is to say power or signal contacts, for mating with respective current transmitting receptacle contacts. The ground blade contact has a contact blade with a projecting tab which is narrower than the contact blade, for engaging with the ground receptacle contact before the contact blade engages with the ground receptacle contact. Each current transmitting blade contact has a contact blade for engaging with the respective current transmitting receptacle contact as the contact blade of the ground blade contact engages with the ground receptacle contact which has an opening for receiving the tab as the contact blades are being mated with the receptacle contacts. The connector assembly can thus handle a full current load.

In order to improve the normal contact force applied to the contact blades by the contact springs of the receptacle contacts, each contact blade may be formed, according to another aspect of the invention, with elongate, parallel raised areas extending towards the forward edge of the contact blade and terminating back therefrom. The raised areas project in opposite directions from the plane of the contact blade for engaging opposed contact surfaces of the mating receptacle contact as the contact blade is inserted therebetween.

These features ensure that the thickness of the metal stock from which the blade contact is made need not be determined by the extent of the minimum gap between the contact surfaces of the receptacle contact, which is dictated in practice by forming and plating requirements. Also, the elongate raised areas serve to wipe any fouling, or metal oxide which may be present on the contact surfaces. Preferred embodiments of the invention will now be described by way of example with reference to the accompanying drawings.

BRIEF DESCRIPTION OF THE DRAWINGS

FIG. 2 illustrates the position of the contacts in the mating connectors as the forwardly projecting tab of the center or ground contact engages the contact surfaces of its receptacle contact.

FIG. 3 illustrates the position of the contacts in the matting connectors as the blade contacts engage their respective receptacle contacts and the forwardly projecting tab of the ground contact about to enter the opening in its receptacle contact.

FIG. 9 illustrates the forwardly projecting tab of the alternative embodiment of the ground contact about to be received in the receptacle contact.

FIG. 10 illustrates the contacts of FIG. 9 as the blade contact engages the receptacle contact with the forwardly projecting tab about to enter the opening in the receptacle contact.

FIG. 11 illustrates the contacts of FIG. 9 after they are fully mated and the tab extending through the opening.

DETAILED DESCRIPTION OF THE PREFERRED EMBODIMENTS

Figure 5:
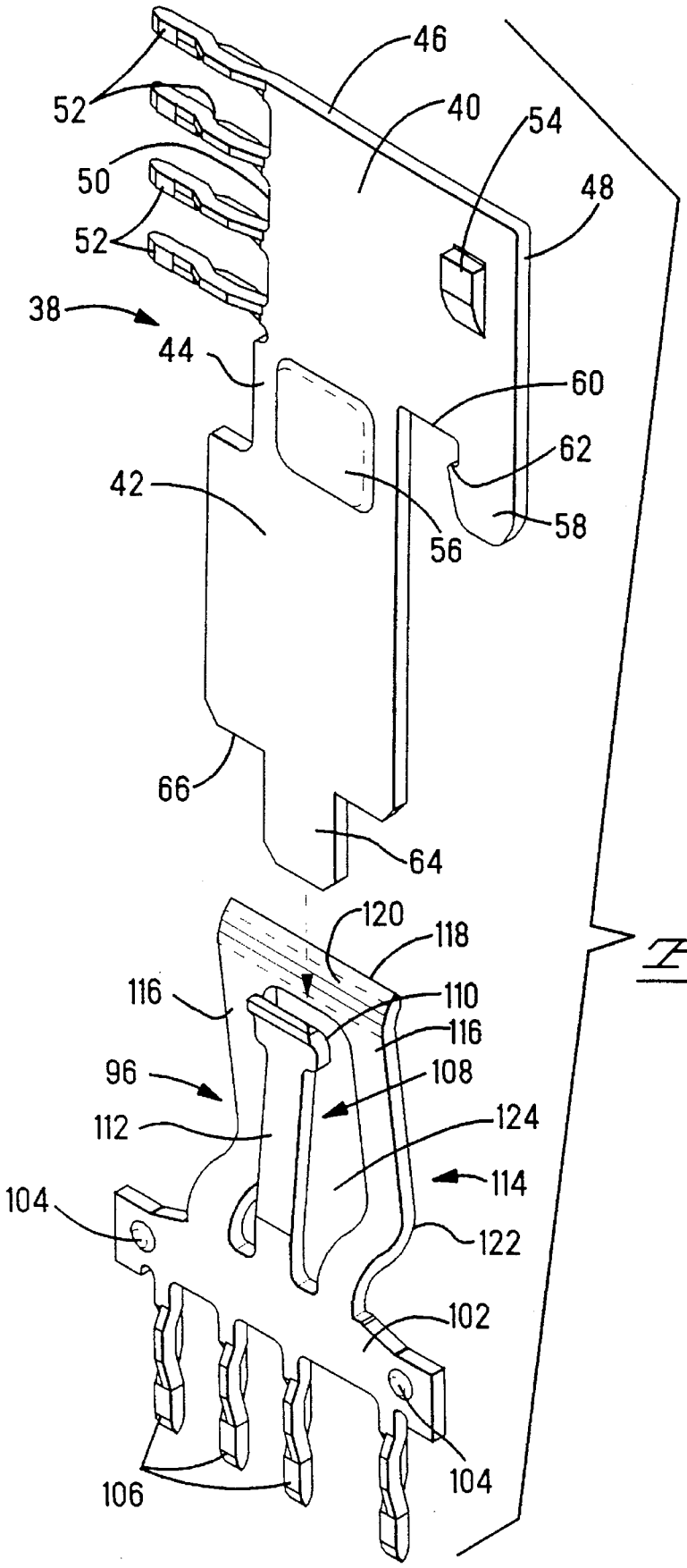
FIG. 5 is an exploded isometric view of mating ground contacts of the connectors.
Figure 6:
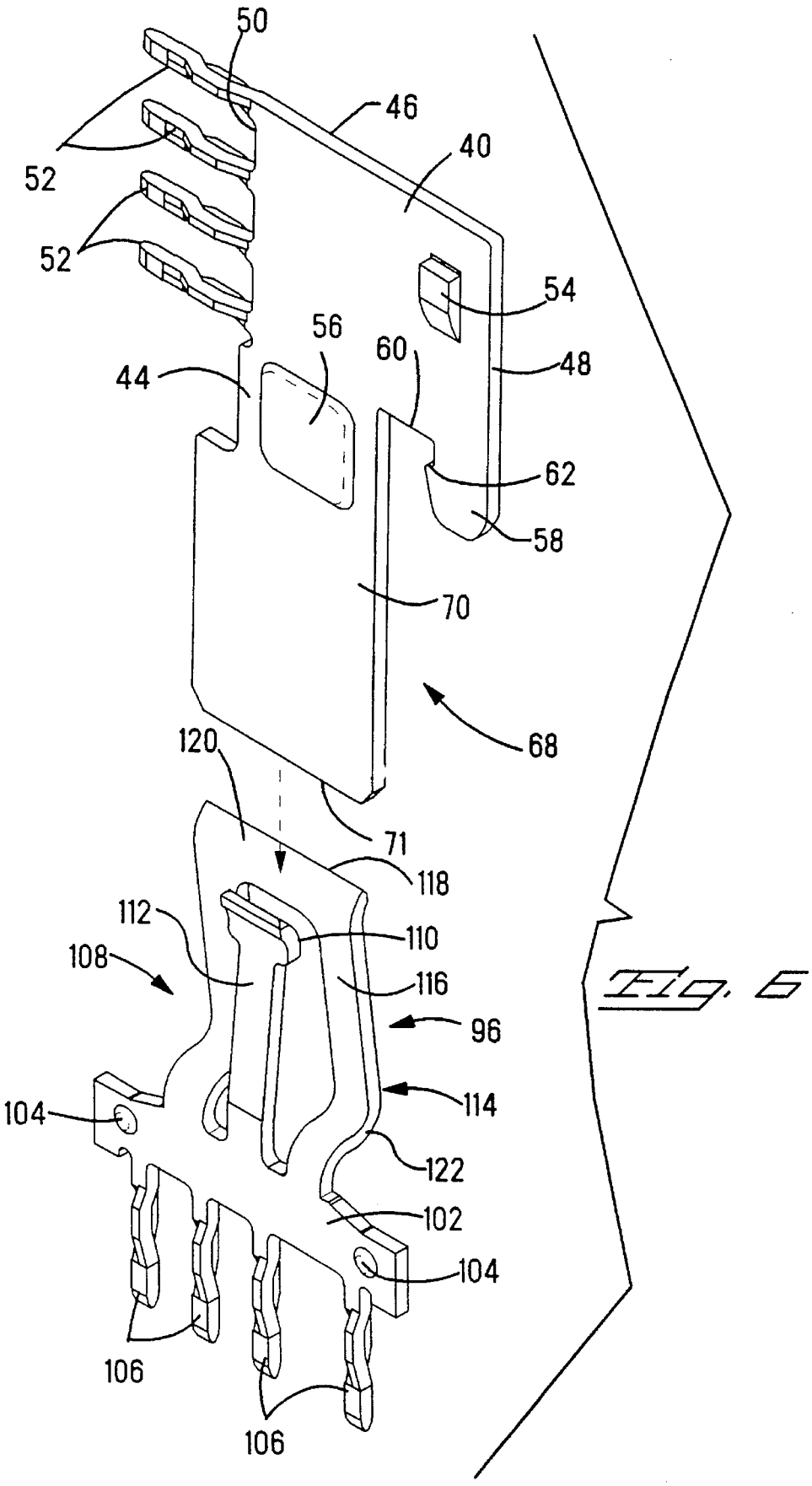
FIG. 6 is an exploded isometric view of mating power contacts of the connectors.
Figure 7:
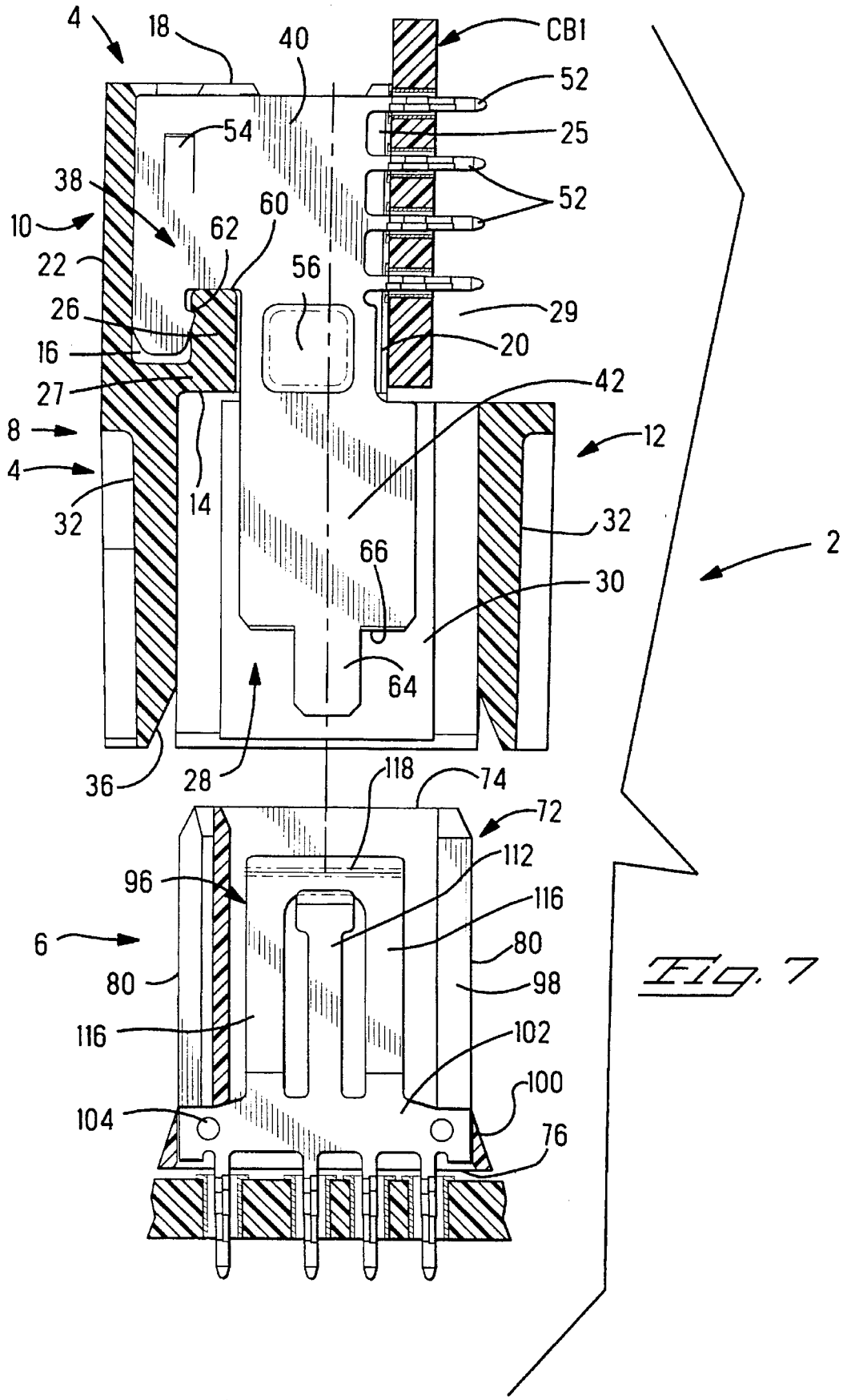
FIG. 7 is a longitudinal sectional view of the power module as shown in FIG. 1, taken at right angles thereto.
Figure 8:
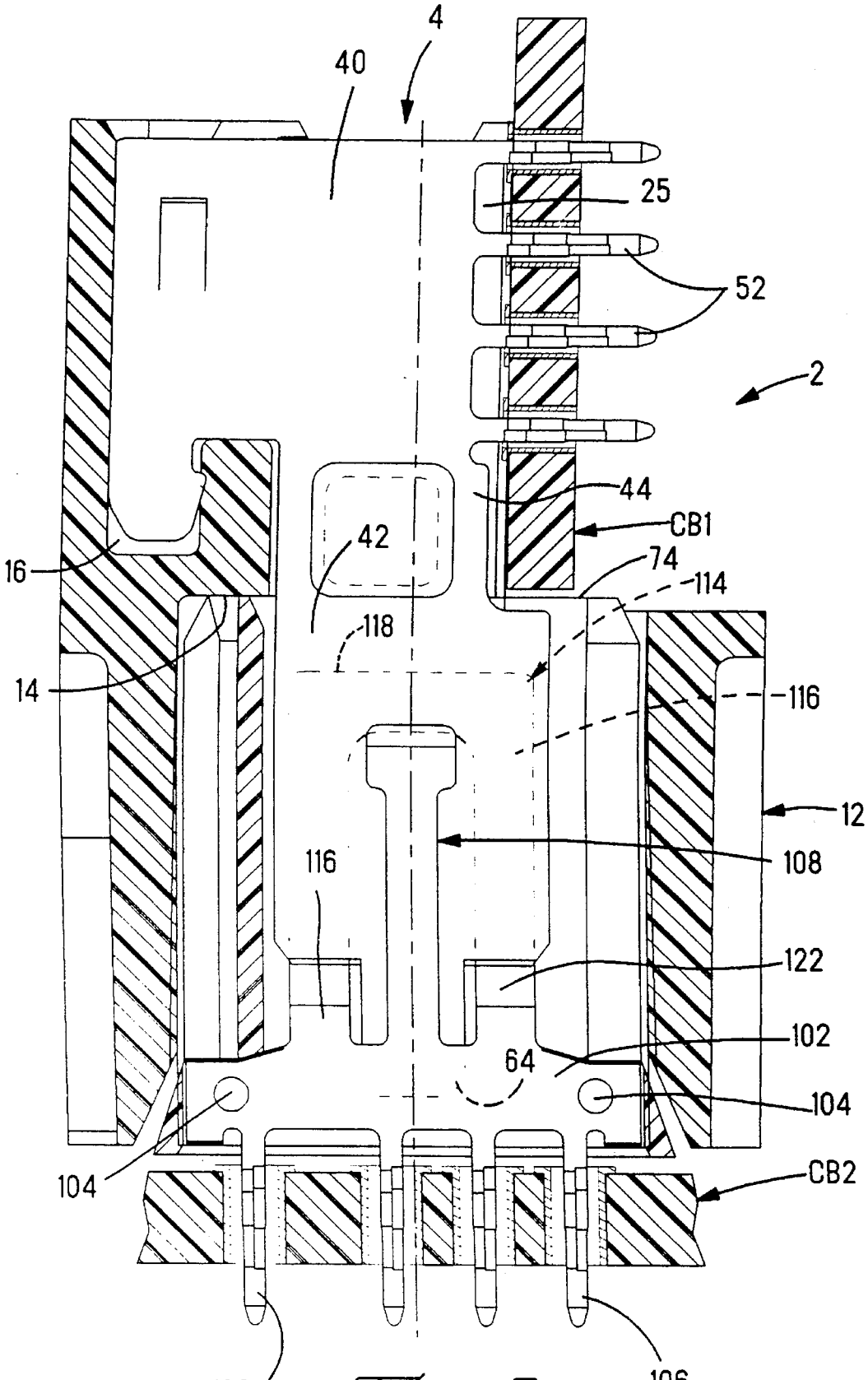
FIG. 8 is a similar view to that of FIG. 7 showing the connectors in mated relationship and being drawn to a larger scale than FIG. 7.

Reference will now be made to FIGS. 1 to 8. An electrical connector assembly in the form of an electrical power module 2 comprises a blade connector 4 and a receptacle connector 6. The blade connector 4 comprises an insulating housing 8 having a body 10 and a shroud 12 projecting forwardly from a mating face 14 of the body 10. As shown in FIGS. 7 and 8, the body 10 defines a central, contact receiving cavity 16. The body 10 has two outer, contact receiving cavities 17, which are indicated in broken lines in FIG. 1, one cavity 17 being disposed on each side of the cavity 16. Since the cavities 16 and 17 are identical, only the cavity 16 will be described here. The cavity 16 has a rearward, contact receiving, open side 18 and a laterally open side 20 adjacent thereto. The body 10 has an end wall 22 opposite to the open side 20 and opposite side walls 24 adjacent to the side 20. The cavity 16 has opposite side walls 25, only one of which is shown (FIGS. 7 and 8). There projects rearwardly, from a forward rudimentary wall 27 of the body 10, rearwardly into the cavity 16, a contact retention rib 26. As shown in FIGS. 7 and 8, the shroud 12 projects rightwardly (as seen in FIGS. 7 and 8), beyond the open side 20 of the cavity 16 to define, in cooperation with the body 10, a recess 29. Each cavity 16 and 17 opens forwardly into an internal cavity 28 of the shroud 12. The shroud 12 has opposite side walls 30 and opposite side walls 32, having respective guide chamfers 34 and 36 at their forward ends.

A substantially uniplanar ground blade contact 38, which is best seen in FIG. 5, is secured in the central cavity 16. The blade contact 38 best seen in FIG. 5, comprises a rearward blade support plate 40 and a forwardly projecting contact blade 42 connected to the blade 40 by a transition neck 44. The plate 40 has a rectilinear rear edge 46, from which extends at right angles thereto, a lateral edge 48. There extend normally, from a lateral edge 50 of the plate 40, opposite to the edge 48, compliant contact tails 52. The plate 40 has a latching tongue 54 proximate to the edge 48 and the transition neck 44 has a retention boss 56 projecting in the same direction as the tongue 54. There projects forwardly from a forward edge 60 of the plate 40, a retention lug 58 having a retention barb 62 facing the transition neck 44. The contact blade 42 has a tab 64 projecting forwardly from the forward edge 66 of the blade 42. The width of the tab 64 is approximately one third of the overall width of the blade 42. As will be apparent from FIGS. 7 and 8, the ground blade contact 38 was inserted through the open side 18 of the cavity 16 with the tab 64 leading, so that the boss 56 pressed against the proximate side wall 25, the latching tongue 54 engaging a shoulder (not shown) of the side wall 25 and the barb 62 biting into the retention rib 26, the blade contact 38 being thereby secured in the cavity 16 with the contact tails 52 projecting from the open side 20 of the cavity 16 into the recess 29 and the contact blade 42 projecting forwardly into a cavity 28 of the shroud 12. The connector 4 further comprises a pair of power blade contacts 68, one of which is shown in FIG. 6. Those parts of the contact 68 which are identical with corresponding parts of the contact 38 bear the same reference numerals as in the contact 38. Each contact 68 differs from the contact 38 in that the contact blade 70 of the contact 68 is devoid of the tab 64, having a rectilinear forward edge 71. Each power blade contact 68 is retained in a respective one of the cavities 17 in the same manner and in the same orientation as the ground blade contact 38 is retained and oriented in its cavity 16. Thus, the contact blades 70 project forwardly into the cavity 28 of the shroud 12 and the contact tails 52 of each contact 68 project from the housing body 10 in parallel relationship with the contact tails of the ground contact 38.

With the contacts 38 and 68 disposed in the housing 8 as described above, the connector 4 is mounted to the edge of a first circuit board CB1 such that board CB 1 is positioned in the recess 29 with the contact tails 52 of the ground contact 38 extending through plated holes in the board CB1 and electrically connected to a ground conductor or ground conductors (not shown) thereon by means of a compliant portion, solder or other means as known in the art. The contact tails 52 of the power contacts 68 extending through further plated through holes in the board CB1 and electrically connected to power conductors thereon.

The receptacle connector 6 comprises an insulating housing 72 for mating reception to the shroud 12 of the connector 4. The housing 72 has a mating face 74, a contact receiving face 76 opposite thereto, opposite side walls 78 and opposite end walls 80. The housing 72 defines a central contact receiving cavity 82 and a lateral contact receiving cavity 84 on each side thereof. Each cavity 82 and 84 opens at its forward end into a contact blade guide slot 86 in the mating face 74, and opens at its rear end into the contact receiving face 76. The central cavity 82 is separated from cavities 84 by partitions 88. As shown in FIGS. 7 and 8, each end wall 80 has a vertical slot 98 extending between the faces 74 and 76 and a chamfered outer edge 100 proximate to the face 76.

In each of the cavities 82 and 84 is an identical receptacle contact 96 which is best shown in FIGS. 5 and 6. Each contact 96 comprises a rearward elongate base 102 having at each end thereof a retention boss 104. There depend from the rear edge of the base 102 compliant contact tails 106 identical with the contact tails 52 of the contacts 38 and 68. There upstands from the forward edge of the base 102, a contact spring 108 having an inwardly bowed, smoothly arcuate, transverse contact surface 110 surmounting a forwardly extending spring arm 112. The contact surface 110 is of substantially the same width as the tab 64. A further contact spring 114 comprises a pair of spring arms 116 each extending from the forward edge of the base 102, on opposite sides of the contact spring 108 and being joined at their forward ends by a strap 118 having an inwardly bowed, smoothly arcuate, transverse contact surface 120, spaced slightly forwardly of the contact surface 110. The contact surface 120 is of substantially the same width as the contact blade 42. Each spring arm 116 has a bent portion 122 proximate to the base 102 laterally offsetting the arm 116 from the contact spring 108, whereby an opening 124 is provided near the base 102, between the contact springs 108 and 114. Contact springs 108 and 114 converge slightly in the forward direction. Each contact 96 is inserted into its cavity in the housing 72 by way of the contact receiving face 76, with the end portions of the base 102 received in the rear end portions of the slots 98, and the bosses 104 engaged against the slot walls. The contact 96 is thereby temporarily retained in position in their cavities while the contact tails 106 are inserted through plated through holes in a second circuit board CB2 and are electrically connected to respective conductors (not shown) thereon. The contact tails of the receptacle contact in the cavity 82 are electrically connected to a ground conductor or ground conductors on the board CB2, while the contact tails of the contacts 92 in the cavities 84 are electrically connected to respective power conductors in the board CB2.

Figure 1:
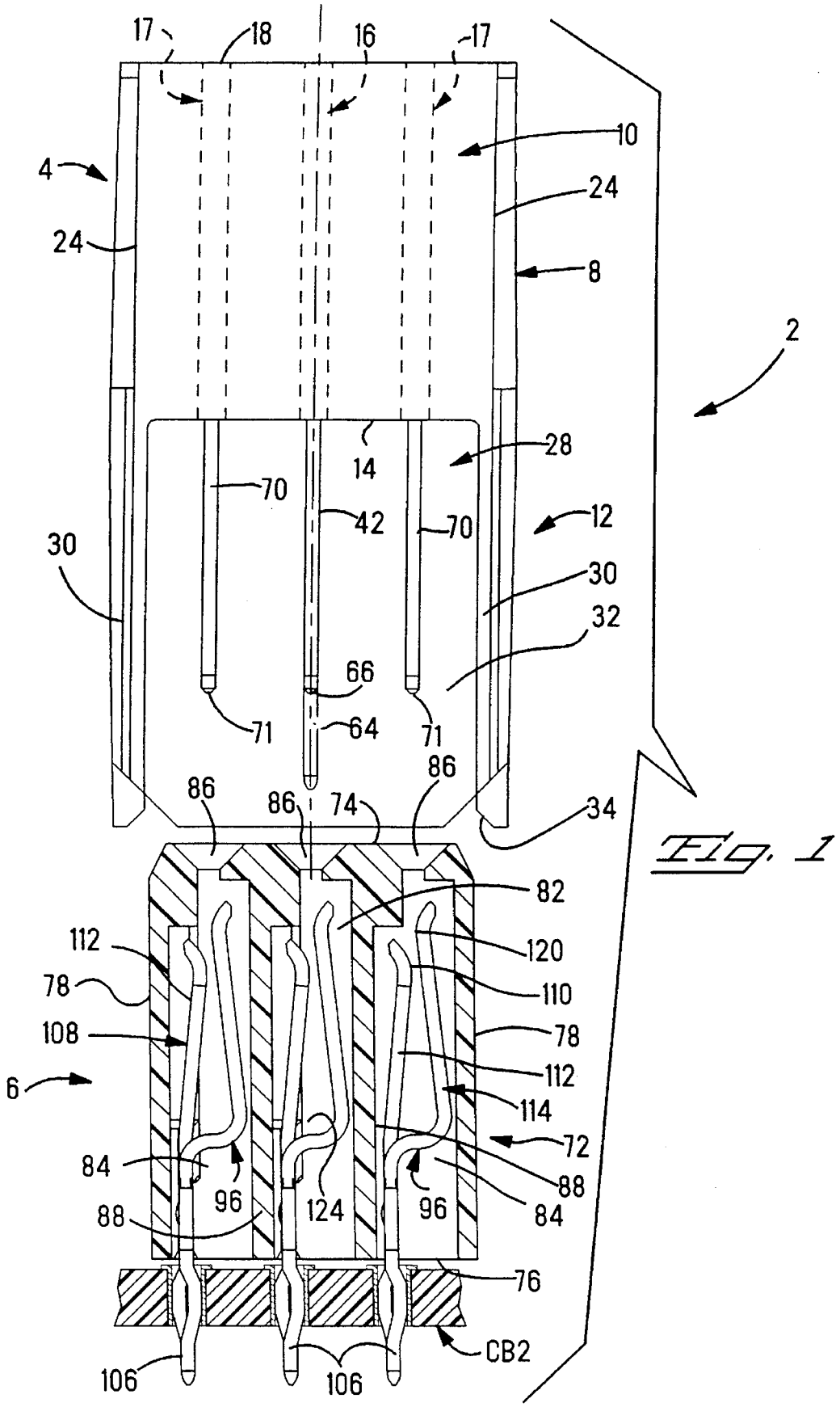
FIG. 1 is an exploded elevational view of an electrical connector assembly in the form of an electrical power module comprising a blade connector and a receptacle connector, the blade connector being shown partly diagrammatically with part omitted in order to reveal contact blades thereof, and the receptacle connector being shown in section.
Figure 2:
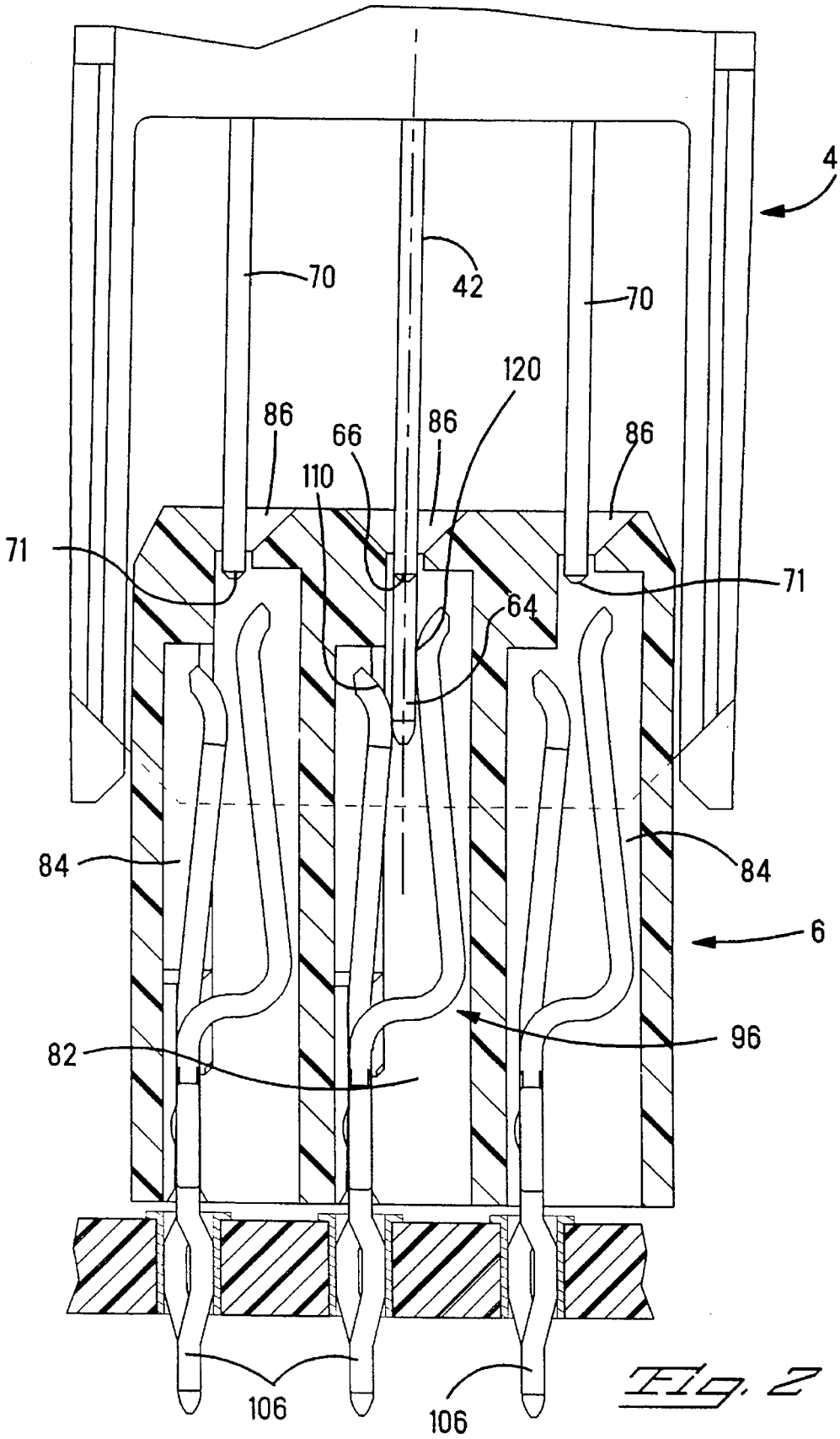
FIGS. 2 to 4 are views similar to that of FIG. 1 but showing respective stages in the mating of the blade and receptacle connectors, the blade connector being shown in fragmentary form.

The mating of the connectors 4 and 6 will now be described with particular reference to FIGS. 1 to 4 and FIGS. 7 and 8. In the position of the connectors and 6 as shown in FIGS. 1 and 7, each blade 42 and 70 is aligned with contact surfaces 110 and 120 of a respective receptacle contact 96. When the connector 4 is advanced to the position of FIG. 2, the forward edge 71 of each blade 70 then enters the guide slot 86 of a respective cavity 84 and the forward edge 66 of the blade 42 enters the guide slot 86 of the cavity 82. The tab 64, however, which projects forwardly from the edge 66 of the blade 62 engages between both of the contact surfaces 110 and 120 of the ground receptacle contact 96 in the central cavity 82 of the housing 72. The ground circuit of the power module 2, is therefore made before the power circuit thereof, since the blades 70 are, at this time, spaced from the power contacts 96. When the connector 4 is advanced to the position of FIG. 3, each of the blades 42 and 70 passes between the contact surfaces 110 and 120 of a respective contact 96, whereby the power circuit of the module 2 is also made. The tab 64 then lies between spring arms 112 and 116 of the ground contact 96 in the cavity 82. When the connector 4 has been advanced to its fully mated position with the connector 6, as shown in FIGS. 4 and 8, with the mating face 14 of the connector 4 engaging the mating face 74 of the housing 72, the forward edges 66 and 71 of the blades 42 and 70 lie proximate to the bent portions 122 of the contacts 96, the housing 72 of the connectors 6 being then fully received in the cavity 28 of the shroud 12. As the connector 4 is advanced from the position of FIG. 3 to that of FIG. 4, the tab 64 passes through the opening 124 between the contact springs 108 and 114 of the contact 96 in the cavity 82, so as to lie beside the base 102 of the contact 96. As the connectors 4 and 6 are unmated, the connector 4 is retracted between the positions of FIGS. 4, 3, 2 and 1 respectively. In the position of FIG. 2 the blade 42, by way of its tab 64, enters between the contact surfaces 110 and 120 of the contact 96 in the cavity 82 after the blades 70 have been retracted from the contacts 96 in the cavities 84. Thus, the ground circuit of the module 2 remains made, until after the power circuit of the module has been broken. As the contact blades disengage from their receptacle contacts substantially simultaneously the power module no longer has its full current load.

Figure 3:
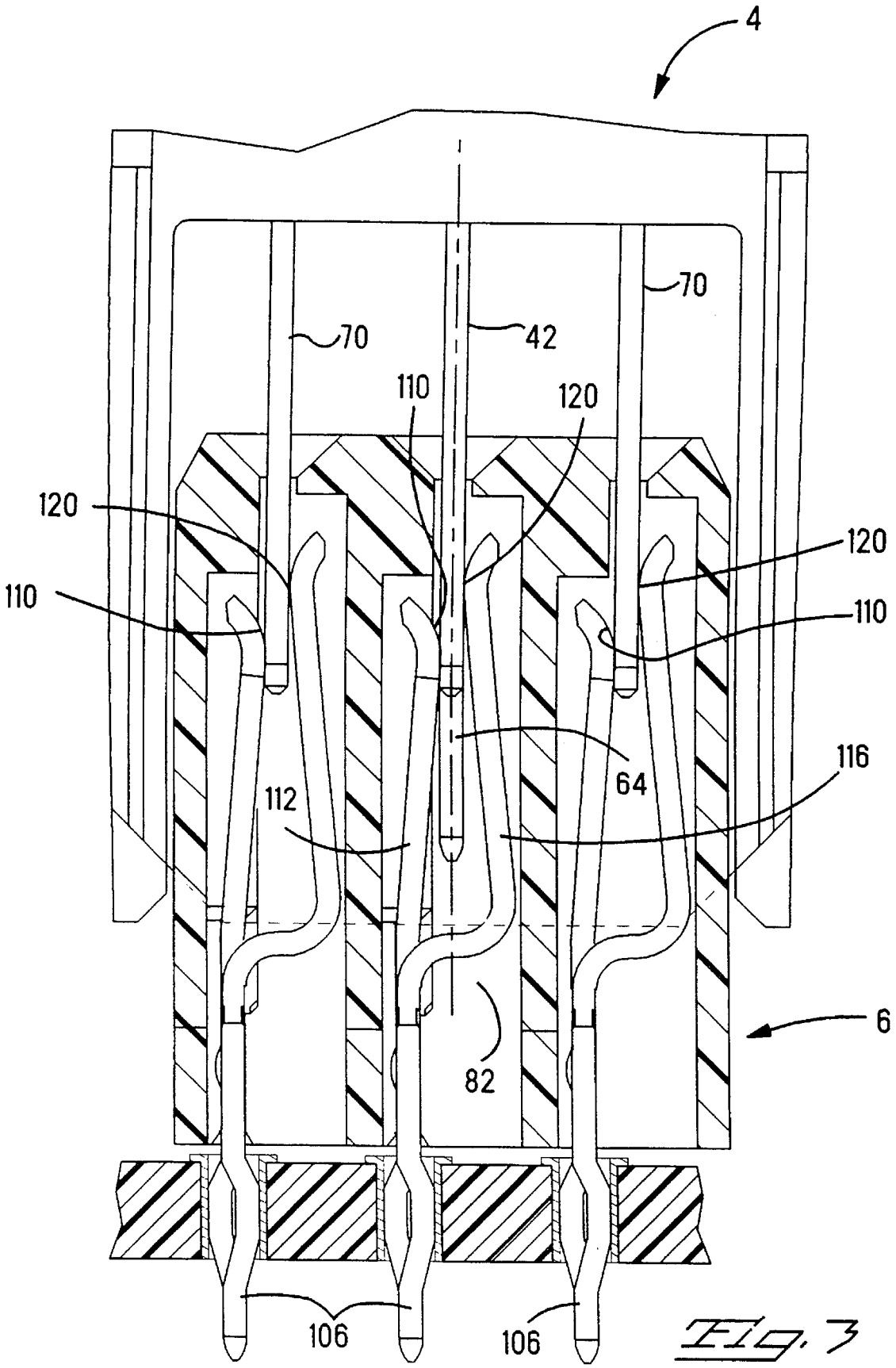
Figure 4:
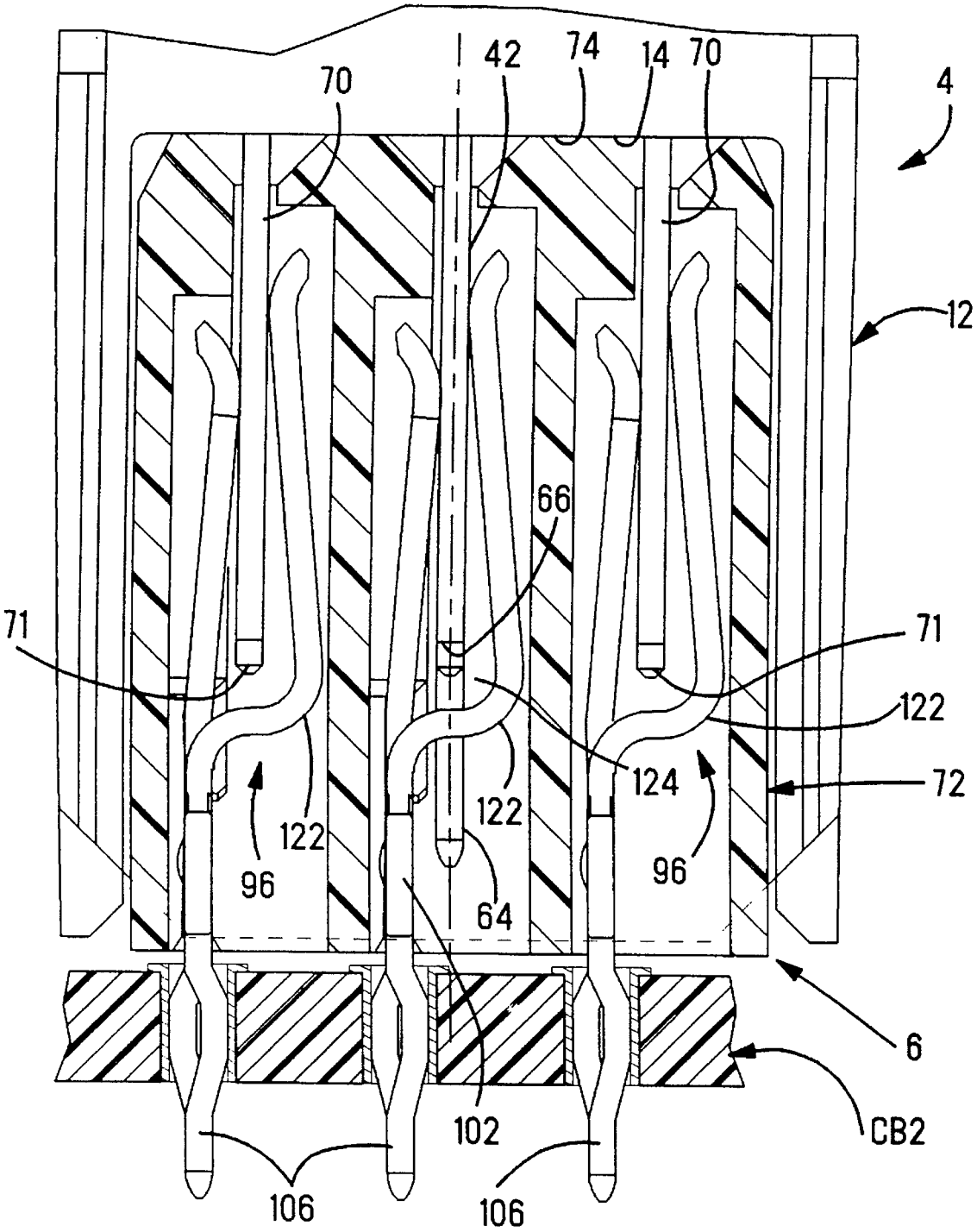

When the blades are inserted between the contact surfaces 110 and 120, the spring arms 112 and 116 of the contacts 96 are cammed resiliently apart as shown in FIGS. 2 and 3. The blade insertion forces are, however, reduced because the contact surfaces 110 and 120 are offset from each other in the mating direction. Since the blades 70 have no tabs projecting therefrom, the contacts in the cavities 84 need not be identical with the contact 96 in the cavity 82, but may be conventional contacts of the tulip type, for example. In the interest of manufacturing, inventory keeping, and convenience, however, all of the receptacle contacts are preferably identical.

The connectors 4 and 6 may have a greater number of power and ground contacts and in other arrangements than those described above, and furthermore may be used other than as a power module, the current transmitting contacts being signal contacts instead of power contacts, for example.

The contacts 38, 68 and 96 are stamped from sheet metal stock by means of progressive die stamping and forming operations and at least their contact surfaces will usually be plated, for example, with gold or tin, in accordance with the field of use of the contacts. In the case of the receptacle contacts 96, the contact springs 108 and 114 must be spaced by a certain minimum gap in the interest of forming and plating requirements. Thus, if there is to be a sufficient normally acting force between a blade and a receptacle contact, the blade must be of a maximum thickness which is compatible with said gap. Nevertheless, in the interest of economy of metal, the thickness of the metal stock from which the blade contacts are stamped, is preferably less than said maximum thickness.

Figure 9:
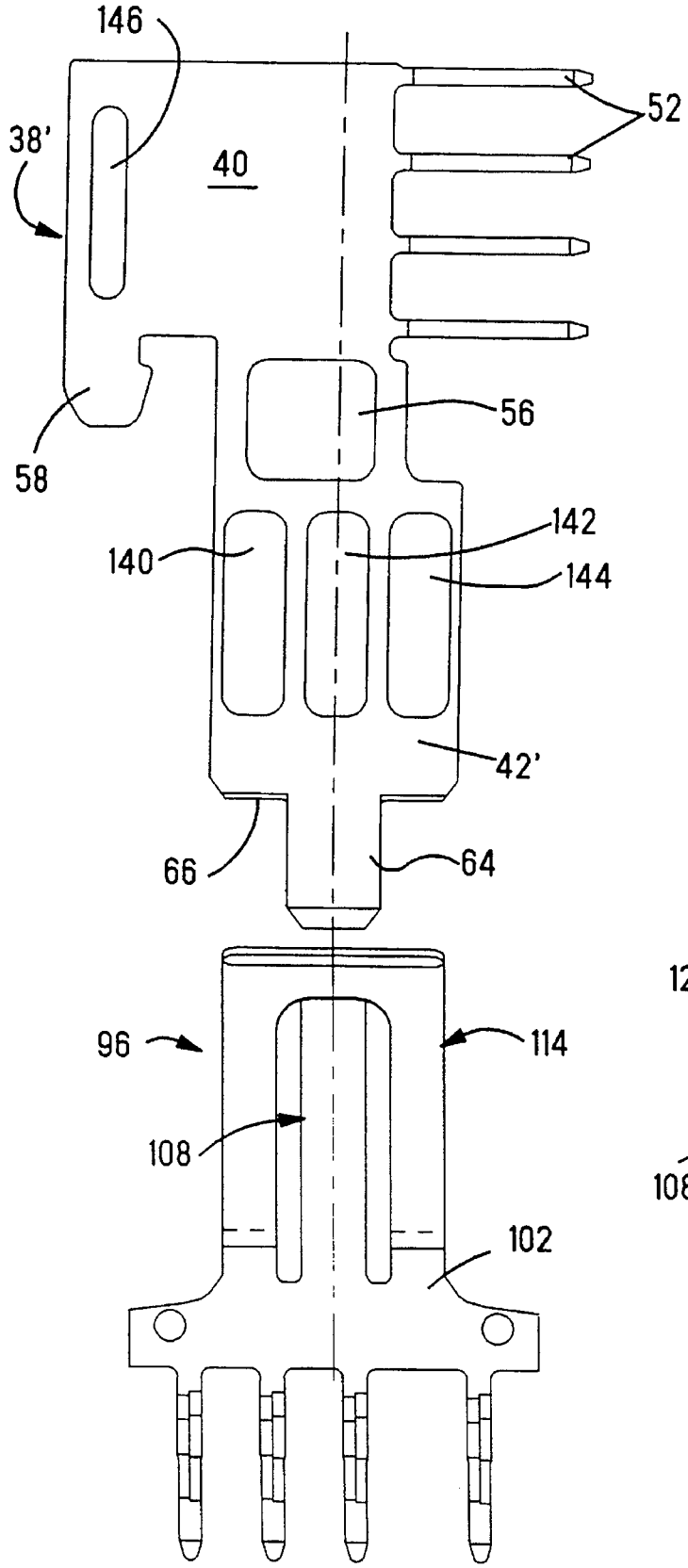
FIGS. 9 to 11 are elevational views of the mating ground contacts illustrating an alternative embodiment and showing respective stages in the mating of the ground contacts.
Figure 12:
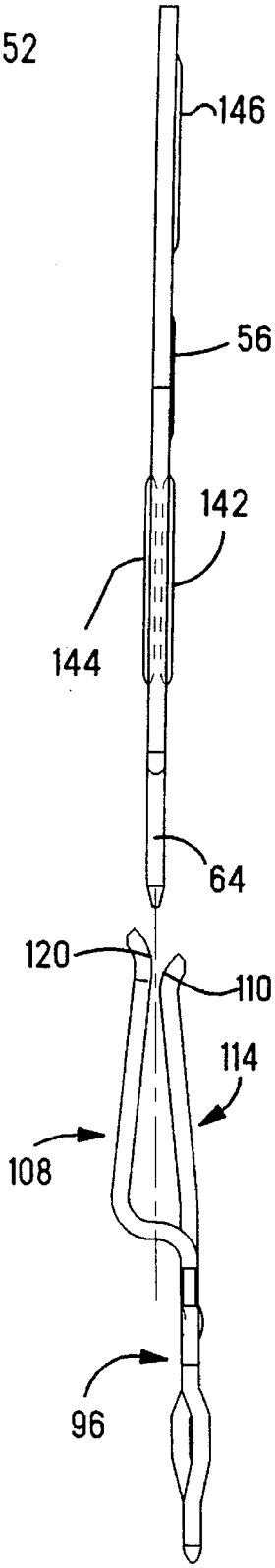
FIG. 12 is an end view of the contacts of FIG. 9.
Figure 10:
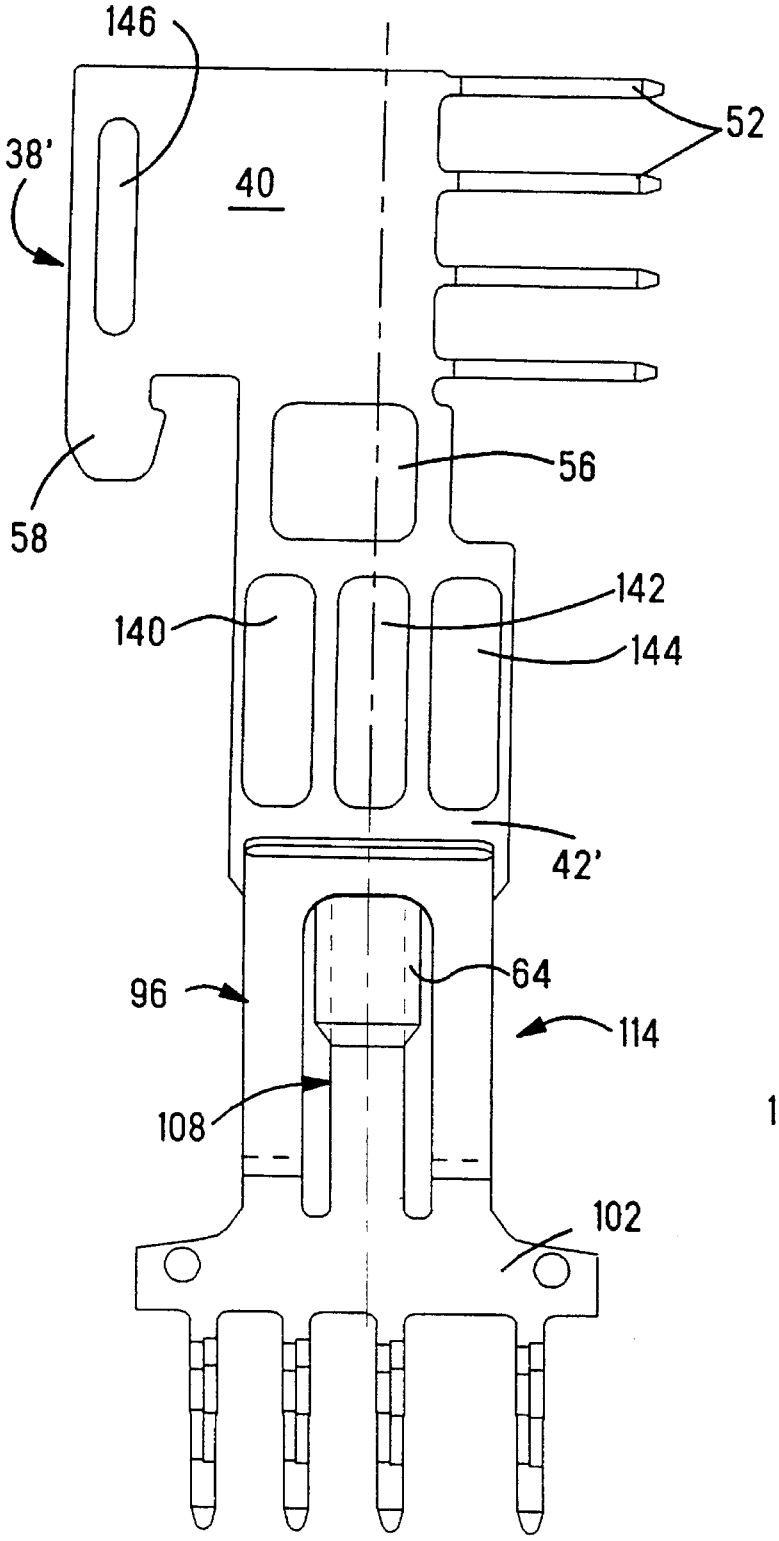
Figure 13:
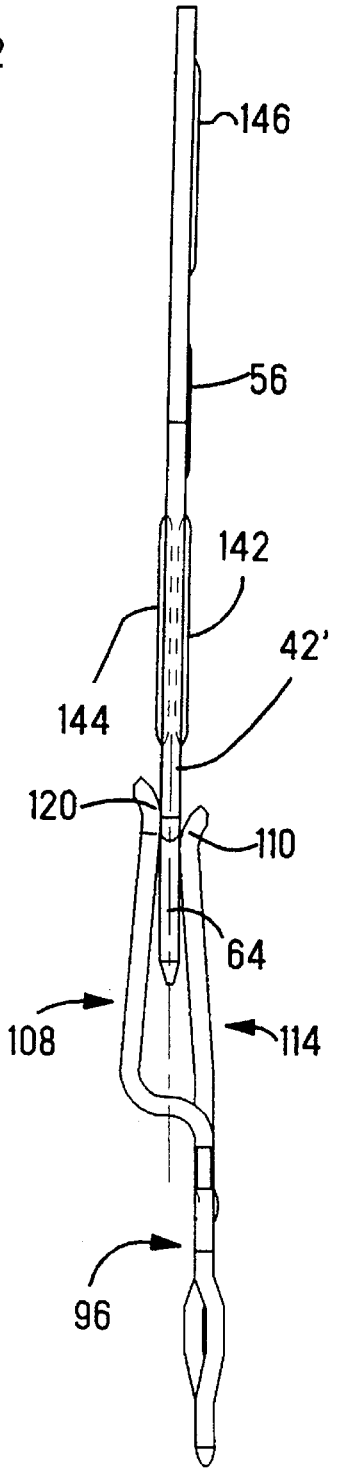
FIG. 13 is an end view of the contacts of FIG. 10.
Figure 11:
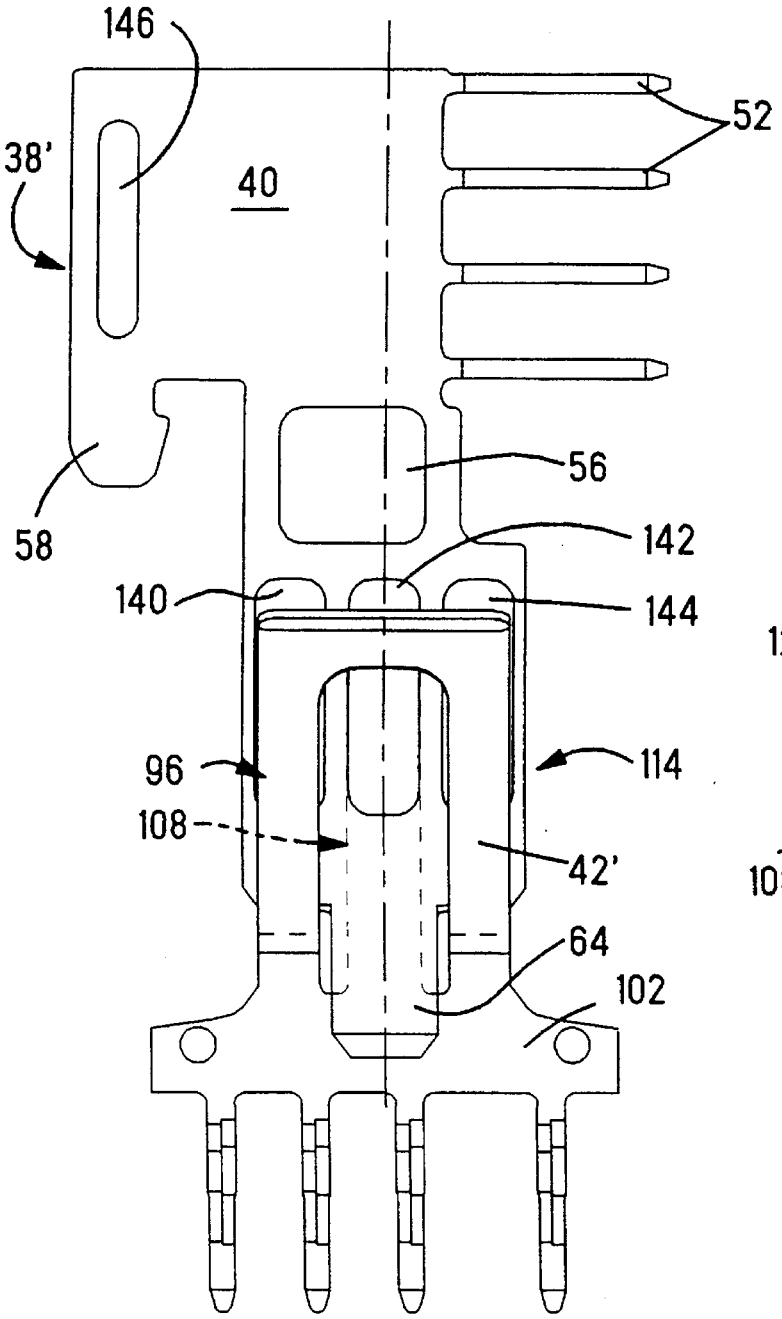
Figure 14:
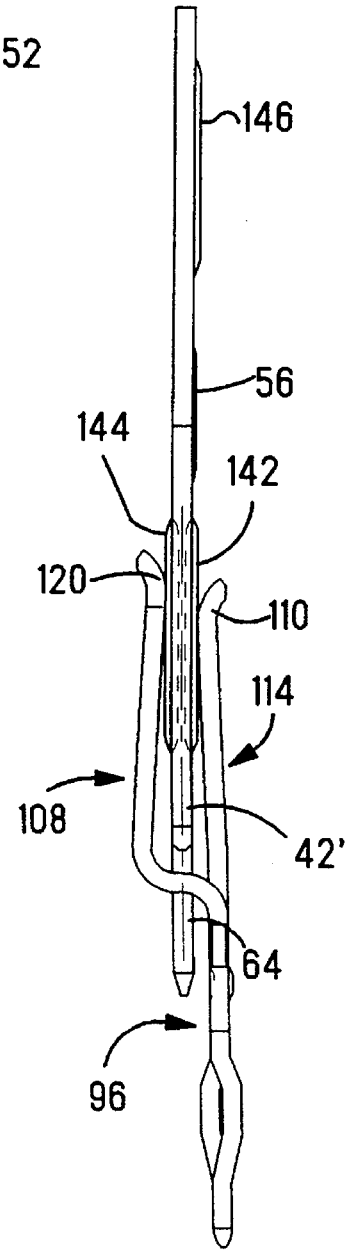
FIG. 14 is an end view of the contacts of FIG. 11.

Another embodiment of the blade contact 38, which enables such economy to be achieved, will now be described with reference to FIGS. 9 to 14, in which those parts which are identical with corresponding parts of the contact 38 described above, bear the same reference numerals as said corresponding parts. A blade contact 38' shown in FIGS. 9 to 14, differs from the blade contact 38, described above, in that the part of the blade 42' which passes between the contact surfaces 110 and 120 of the receptacle contact 96 is formed with elongate, laterally aligned raised areas 140, 142 and 144 which extend longitudinally of the blade 42' all to the same extent, and which are evenly spaced laterally of the blade 42'. Each raised area terminates back from the forward edge 66 of the contact blade 42'. The raised areas 140 and 144 project from the plane of the blade 42' in the opposite sense to the raised area 142 which is located between the areas 140 and 144. FIGS. 9 and 12 show the receptacle contact 96 before the tab 64 is inserted between the contact springs 108 and 114, with the contact surfaces 110 and 120 thereof defining said minimum gap. FIGS. 10 and 13 show the tab 64 inserted between the contact surfaces 110 and 120, the contact springs 108 and 114 being thereby resiliently deflected to produce a moderate normal contact force between the tab 64 and the contact surfaces 110 and 120. When, as shown in FIGS. 11 and 14, the blade 42' is inserted into the receptacle 96, the raised areas 140, 142 and 144 engage the contact surfaces 110 and 120 to produce a greater resilient deflection of the contact springs 108 and 114 thereby providing a substantially higher normal contact force between the tab 64' and the contact surfaces 110 and 120. During the insertion of the blade 38' the raised areas 140 and 144 wipe the contact surface 120 near the ends of the strap, in line with spring beams 114, and the raised area 142 wipes the contact surface 110. The raised areas 140, 142 and 144 are sufficiently elongate in the mating direction to provide effective wiping of the contact surfaces 110 and 120 to remove any fouling or metal oxide, as the case may be, from the contact surfaces. Similar raised areas are preferably also provided on the contact blades 70 of the blade contacts 68. The blade contact 38' also differs from the blade contact 38 in that its support plate 40 is formed with a retention rib 146 instead of with the latching tongue 54.

Figure 15:
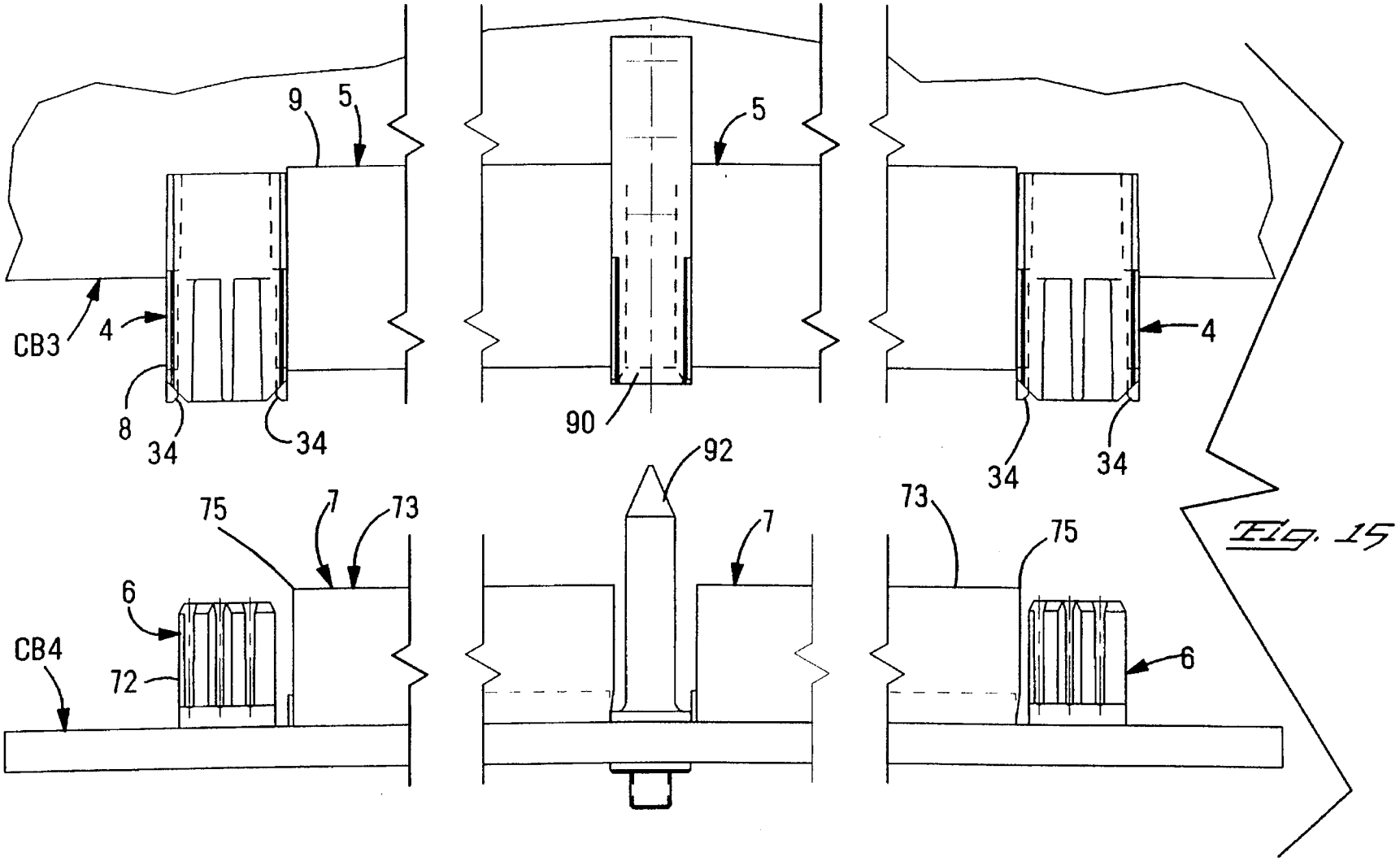
FIG. 15 is a diagrammatic view of an arrangement of power modules made in accordance with the invention and signal modules mounted on a mother board and a corresponding complementary arrangement of power and signal modules on a daughter board.

FIG. 15 illustrates an arrangement of blade connectors 4 and signal receptacles 5 mounted to daughter board CB3 and a complementary arrangement of receptacle connectors 6 and headers 7 mounted to mother board CB4. The arrangements also show guide modules 90,92, which aid in aligning the modules as the respective connectors 4,5 on daughter board CB3 are mated with the complementary connectors 6,7 on mother board CB4. FIG. 15 also illustrates that housing 8 of blade connector 4 extends beyond the housing 9 of receptacles 5 and that the housing 72 of connector 6 is shorter that housing 73 of header 7. The leading edge of housing 8 is beveled at 34 to minimize stubbing of housing 8 with the corner 75 of housing 73 as the respective connectors are mated.

The embodiments described above could be modified in various ways, for example each connector could be provided with both blade contacts and receptacle contacts.

It is thought that the electrical contacts of the present invention and many of its attendant advantages will be understood from the foregoing description. It is apparent that various changes may be made in the form, construction, and arrangement of parts thereof without departing from the spirit or scope of the invention, or sacrificing all of its material advantages.

What is claimed is:

1. A pair of mating electrical contacts, comprising:

a blade contact having a rearward blade support for retention in a first insulating housing, a contact blade of a first width projecting forwardly from the blade support to a transverse leading edge, and a tab of a second width which is substantially less than said first width, projecting forwardly from said transverse leading edge of the contact blade; and a receptacle contact having a rearward base for retention in a second insulating housing, and first and second contact springs projecting forwardly from said base, the first contact spring having a first transverse contact surface and the second contact spring having a second transverse contact surface of a width which is substantially greater than said first width, said first and second contact surfaces being cooperable to apply contact forces initially to the tab and then to the contact blade as the contacts are being mated, and the second contact spring defining a rearward opening for receiving the tab.

2. A pair of mating contacts as claimed in claim 1, wherein the width of the contact surface of the first contact spring is substantially equal to the width of the tab and the width of the contact surface of the second contact spring is substantially equal to the width of the contact blade.

3. A pair of contacts as claimed in claim 1, wherein the tab projects centrally from said transverse leading edge of the contact blade.

4. A pair of contacts as claimed in claim 1, wherein the second contact spring comprises a pair of spring arms connected to said base on opposite sides of the first contact spring, a strap connecting the spring arms being bowed towards the first contact spring to define the second contact surface which is continuous.

5. A pair of contacts as claimed in claim 4, wherein each spring arms is connected to said base by way of a bent portion offsetting the spring arms from the first contact spring to provide said opening for receiving the tab.

6. A pair of contacts as claimed in claim 1, wherein the blade support of the blade contact is a plate which is coplanar with the contact blade and the tab, and wherein compliant contact tails project from an edge of the plate transversely of the contact blade.

7. A pair of contacts as claimed in claim 6, wherein the plate is connected to the contact blade by way of a transition neck, a retention lug depending from an edge of the plate, beside the transition neck and having a retention barb facing the transition neck.

8. A pair of contacts as claimed in claim 1, wherein compliant contact tails project from the rearward edge of the base of the receptacle contact, and wherein retention bosses are formed on opposite ends of the base.

9. A pair of contacts as claimed in claim 1, wherein the contact blade is formed with raised areas extending longitudinally of the contact blade and projecting on opposite sides of the plane of the contact blade for engaging the contact surfaces of the contact springs of the receptacle contact.

10. A pair of contacts a claimed in claim 9, wherein a plurality of the raised areas project from one side of the contact blade for engaging the contact surface of the second contact spring.

11. An electrical connector assembly comprising mating electrical connectors having a ground blade contact for mating with a ground receptacle contact and at least one current transmitting blade contact for mating with a respective current transmitting receptacle contact, the ground blade contact having a contact blade with a transverse leading edge and a projecting tab which is narrower than the contact blade extending forwardly from said leading edge, for engaging with the ground receptacle contact before the contact blade engages with the ground receptacle contact, each current transmitting blade contact having a contact blade having a transverse leading edge adapted to engage with the respective current transmitting receptacle contact substantially simultaneously as the leading edge of the contact blade of the ground blade contact engages with the ground receptacle contact, the ground receptacle contact having an opening for receiving the tab as the contact blades are being mated with the receptacle contacts.

12. An assembly as claimed in claim 11, wherein the ground receptacle contact has a first and a second contact spring upstanding from a base, the first contact spring having a contact surface of substantially same width, transversely of said contact spring, as the tab, and the second contact spring having a contact surface of substantially the same width, transversely of that contact spring, as the contact blade of the ground blade contact.

13. An assembly as claimed in claim 12, wherein the contact springs are relatively offset from each other proximate to the base, to define said opening.

14. An assembly as claimed in claim 11, wherein each blade contact is substantially coplanar, and has a contact blade support plate retained in a cavity in an insulating housing of the respective connector, at least one contact tail projecting from a lateral edge of the support plate and being electrically connected to a conductor on a circuit board.

15. An assembly as claimed in claim 14, wherein the support plate is connected to the contact blade by way of a transition neck, the support plate having a retention lug depending beside the transition neck and having a retention barb facing the transition neck and engaging a wall of the housing protruding between the transition neck and the retention lug.

16. An assembly as claimed in claim 11, wherein each contact blade has a plurality of raised areas extending longitudinally of the contact blade and projecting in opposite directions from the plane of the contact blade for engagement with opposite contact surfaces of the receptacle contact for mating with the contact blade.

17. An electrical blade contact for mating, in a mating direction, with an electrical receptacle contact having opposed contact surfaces, the blade contact comprising a rearward blade support for retention in a cavity in an insulating housing and a contact blade projecting forwardly from the blade support for insertion between said contact surfaces, the contact blade being formed with elongate, parallel, raised areas extending in the mating direction terminating back from a forward edge of the contact blade, and projecting in opposite directions from the plane of the contact blade for engaging said opposed contact surfaces as the contact blade is inserted between said contact surfaces, wherein the raised areas comprise a first raised area located between second and third raised areas, the first raised area projecting from the plane of the contact blade in the opposite direction to the second and third raised areas.

18. A blade contact as claimed in claim 17, wherein the raised areas are evenly spaced from each other transversely of the contact blade and extend therealong to the same extent up to a position back from the forward edge of the contact blade.

19. An electrical blade contact for mating, in a mating direction, with an electrical receptacle contact having opposed contact surfaces, the blade contact comprising a rearward blade support for retention in a cavity in an insulating housing and a contact blade projecting forwardly from the blade support to a transverse leading edge for insertion between said contact surfaces, the contact blade being formed with elongate, parallel, raised areas extending in the mating direction, terminating back from a forward edge of the contact blade, and projecting in opposite directions from the plane of the contact blade for engaging said opposed contact surfaces as the contact blade is inserted between said contact surfaces, wherein a tab extends forwardly from said leading edge of the contact blade, centrally of said leading edge, the width of the tab being substantially one third of the width of the contact blade.

* * * * *